United States Patent [19]

Fridrich et al.

[11] 4,053,809

[45] Oct. 11, 1977

[54] SHORT-ARC DISCHARGE LAMP WITH STARTING DEVICE

[75] Inventors: Elmer G. Fridrich, Chardon; Rolf S. Bergman, Cleveland Heights, both of Ohio

[73] Assignee: General Electric Company, Schenectady, N.Y.

[21] Appl. No.: 697,426

[22] Filed: June 18, 1976

[51] Int. Cl.[2] ..... H01J 61/54

[52] U.S. Cl. ..... 313/198; 313/113; 313/201

[58] Field of Search ..... 313/201, 184, 198, 25, 313/113

[56] References Cited

U.S. PATENT DOCUMENTS

| | | | |
|---|---|---|---|
| 2,152,997 | 4/1939 | Johnson | 313/201 X |
| 2,249,672 | 7/1941 | Spanner | 313/201 X |
| 2,275,739 | 3/1972 | Dellian et al. | 313/24 X |
| 2,313,646 | 3/1943 | Johnson | 313/201 X |
| 2,487,437 | 11/1949 | Goldstein et al. | 313/201 X |
| 3,379,868 | 4/1968 | Taillon | 240/11.4 |
| 3,700,881 | 10/1972 | Slomski | 240/41.35 R |

FOREIGN PATENT DOCUMENTS

| | | | |
|---|---|---|---|
| 484,629 | 5/1938 | United Kingdom | 313/184 |

*Primary Examiner*—Palmer C. Demeo
*Attorney, Agent, or Firm*—Norman C. Fulmer; Lawrence R. Kempton; Frank L. Neuhauser

[57] ABSTRACT

A short-arc discharge lamp having a pair of electrodes sealed into a bulb, and an external starting device comprising an electrical conductor connected to one of the electrodes and extending to the vicinity of the seal of the other electrode.

11 Claims, 6 Drawing Figures

SHORT-ARC DISCHARGE LAMP WITH STARTING DEVICE

BACKGROUND OF THE INVENTION

The invention is in the field of short-arc high-intensity gas discharge lamps, such as are used in certain photographic projectors. It is common practice to manufacture integral lamp and reflector combinations employing such a type of lamp.

A typical short-arc high-intensity discharge lamp comprises a quartz envelope having a thick-wall bulb-like arc chamber, and a pair of elongated electrodes are sealed into the envelope at opposite ends and along a common axis. The envelope includes elongated stems extending along and around portions of the electrodes. The arc length between the inner ends of the electrodes is about 2 or 3 millimeters, and the overall bulb diameter is about 8 to 10 millimeters, and overall length (including stems) is about 5 centimeters, for a 300-watt metal halide gas lamp. Thus, this short-arc lamp has an arc length of less than half the outer bulb diameter. U.S. Pat. No. 3,379,868 to Taillon discloses a short-arc lamp mounted in a reflector laterally of the projected light's optical axis, and U.S. Pat. No. 3,700,881 to Slomski discloses a short-arc lamp mounted in a reflector along the optical axis. U.S. Pat. No. 3,780,342 to Grimshaw et al discloses a ballast circuit for a short-arc lamp, which applies a relatively high starting voltage pulse to the lamp electrodes, followed by a relatively lower operating voltage.

SUMMARY OF THE INVENTION

The principal object of the invention is to improve the starting characteristics of short-arc lamps so they will start more reliably and/or at a lower value of starting voltage, and to accomplish this in an inexpensive manner.

The invention comprises, briefly and in a preferred embodiment, a short-arc type of lamp having a bulb portion, a pair of electrodes extending into the bulb portion, and a starting device comprising an electrical conductor external to the bulb and connected electrically to one of the electrodes and extending to the vicinity of the other electrode. In a preferred embodiment, the electrodes are sealed to the bulb through stems extending outwardly from the bulb portion and along and surrounding portions of the electrodes, and the starting device is connected electrically to one electrode and encircles the stem around the other electrode. In another preferred embodiment, the starting aid comprises a current-supply conductor connected to one of the electrodes. For a lamp intended for d-c operation and having a cathode electrode and an anode electrode, it is preferable to connect the starting conductor to the cathode and extend it to the vicinity of the anode.

DESCRIPTION OF THE PREFERRED EMBODIMENTS

Figure 1:
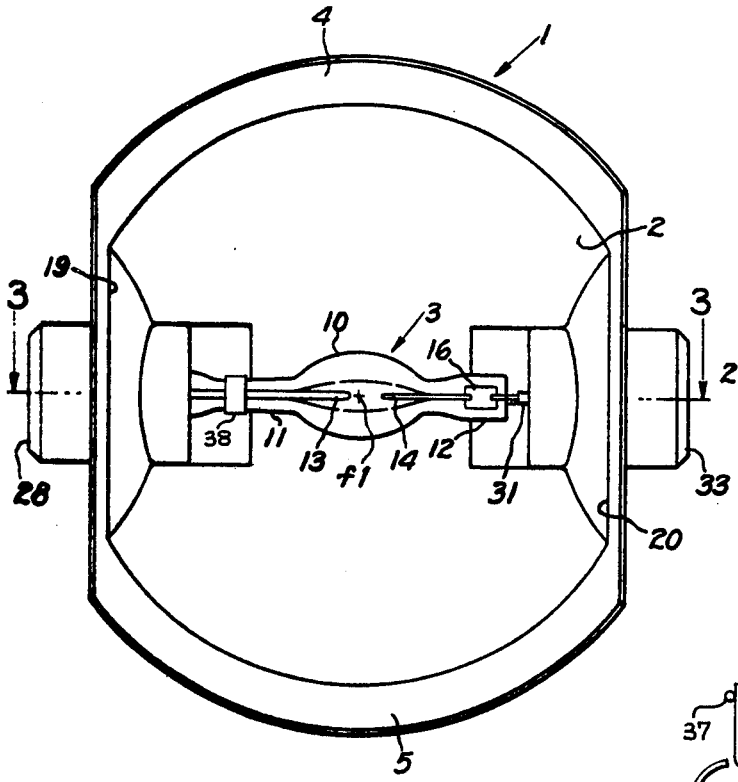
FIG. 1 is a front view of a lamp and reflector combination in accordance with a preferred embodiment of the invention.
Figure 2:
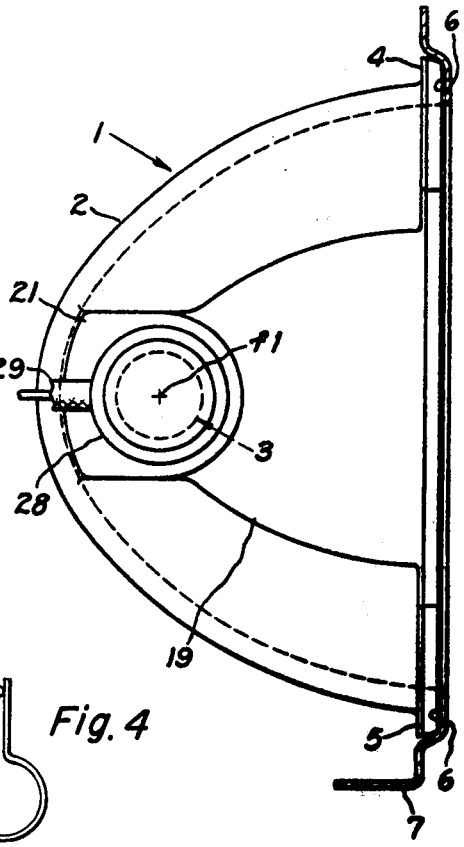
FIG. 2 is a side view of FIG. 1.
Figure 4:
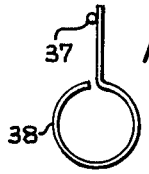
FIG. 4 is an axial view of the starting aid shown in FIGS. 1 and 3.

Referring to FIGS. 1–4 of the drawings, there is illustrated a projection lamp unit 1 comprising a reflector portion 2, preferably made of glass and molded to an ellipsoidal shape, having a light source in the form of an arc tube 3 at its near focus f1. The ellipsoidal shape of the reflector concentrates the light at the far focus which conveniently may be located in front of the rim seating plane of the light unit at a distance about equal to the diameter across the rim. The reflector is provided with two flange segments 4, 5 at its rim by which the lamp is supported against a cooperating seating shoulder 6 in a support member 7 as shown in FIG. 2. By using a glass reflector, dimensional stability is assured. Also, it may be coated on its inner surface with a reflecting coating 8 consisting of a known type of multiple layer interference film which is highly reflective of visible light but transmissive of heat or infrared radiation. A metal reflector with a conventional mirror finish may also be used.

The light source or arc tube 3 comprises a quartz envelope having a generally spherical central portion or bulb 10 provided with generally cylindrical extensions or stems 11, 12. The electrodes 13, 14 consist of lengths of tungsten wire which are welded to molybdenum foils 15, 16, the foils in turn being welded to inleads 17, 18. The foils are wetted by the quartz of the stems to provide hermetic seals. The illustrated lamp is intended for direct-current operation and the anode 13 is of tungsten wire larger in diameter and longer than the cathode 14. In a lamp for a-c operation, the two electrodes would be of the same size and the necks would be equal in length. The lamp operates with the electrodes close to the melting point of tungsten and may operate with substantially molten tips resulting in the rounding and balling of the electrode ends during operation. The lamp contains an inonizable filling which includes an inert gas such as argon and a halogen or metal halide such as indium iodide. By way of example, the overall length of the arc tube quartz body may be 5 centimeters and the outside diameter of the bulb portion may be 9 millimeters with the internal diameter of the discharge space being about 2.5 millimeters and the arc length between the inner ends of the electrodes being about 2.5 millimeters.

Figure 3:
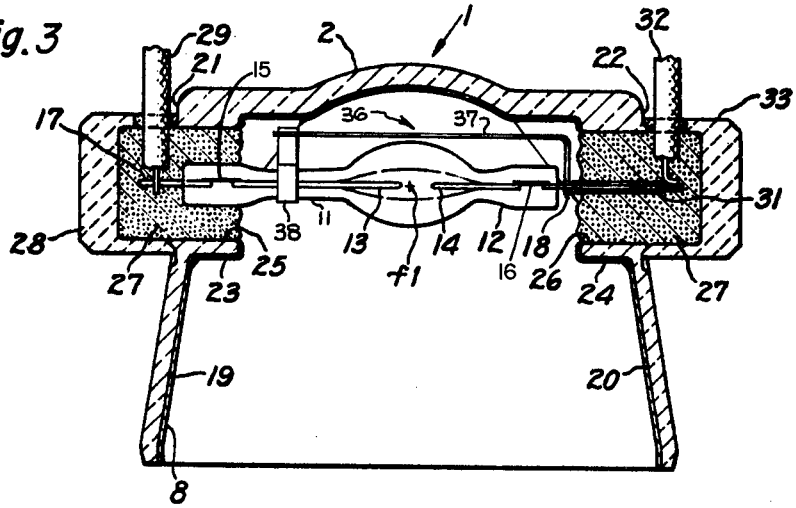
FIG. 3 is a cross-sectional view taken on the line 3—3 of FIG. 1.

Segments are cut away from the sides of the reflector 2 leaving flat vertical side walls 19, 20 which are chord-like in end view as seen in FIG. 1 and tapered rearward slightly towards the axis in plan section as seen in FIG. 3. In the front half of the reflector, the chord-like side walls 19, 20 cut into the normal elliptical curve of the reflector surface, but in the rear half, they are extended into shoulders 21, 22 defining generally wedge-like expansions within the reflector. Within the shoulder expansions, the glass is built up into collars 23, 24 about lateral apertures 25, 26 through the chord walls; the apertures are centered on a line passing through focus f1 and transverse to the optical axis.

Arc tube 3 is mounted laterally of the reflector's optical axis with stem 11 projecting into aperture 25 and set in a glassy cement 27 which fills the volume of the aperture and of a ceramic cap 28 which is placed over the opening. An insulated wire lead 29 is welded to the end of inlead 17 and emerges from cap 28 through a small side aperture at the rear. The stem 12 at the cathode end of the arc tube does not penetrate into aperture 26; a snug-fitting sleeve 31 is provided around inlead 18 and the sleeve projects into lateral aperture 26 and is there set in cement 27. An insulated wire lead 32 is connected to the end of sleeve 31 and emerges from cap 33 through a side aperture to the rear. Before cement 27 sets hard, arc tube 3 is adjusted to optically center the arc at the near focus f1 while the lamp unit as a whole is accurately located relative to the projection system by the flange segments 4, 5. Preferably, a cement is used which sets quickly under heat and bonds to both the glass reflector and the quartz arc tube. One suitable cement comprises primarily fine alumina and calcined kaolin along with minor additions of disodium phosphate and trialuminum phosphate mixed with phosphoric acid to form a paste.

By setting one end of arc tube 3 in cement so that it is rigidly fixed to reflector 2, a projection lamp unit results wherein the arc tube is accurately located in an optical reference system. When subsequently the unit is inserted into a socket properly accommodating flange segments 4, 5, it will provide the desired light at the film gate without further adjustment. At the other end of the arc tube, the inlead is slidably engaged in sleeve 31. This permits differential expansion of the quartz arc tube having a low coefficient of expansion and of the glass reflector having a relatively high coefficient of expansion, without subjecting the parts to excessive strain. At the same time, the displacement of the interelectrode gap relative to the reflector focus as a result of differential thermal expansion is too slight to be of any consequence in the optics of the system. The projector lamp thus far described is similar to that disclosed in the above-referenced Taillon patent. As mentioned above, the lamp 3 requires a ballast circuit which applies a relatively high value of starting voltage (about 8,000 to 10,000 volts).

In accordance with the present invention, the starting voltage of the lamp 3 is reduced and/or the lamps start more reliably by providing a starting aid device 36 comprising an elongated electrically conductive member connected to one of the electrodes or its inlead 18 and extending to the vicinity of the other electrode 13. In the embodiment shown, the starting device 36 comprises a wire 37 welded or otherwise attached to the inlead 18 and extending along and behind the lamp 3, between the lamp and the rear surface of the reflector, and welded or otherwise attached to a metal strap 38 which fits around and encircles the stem 11 of the anode electrode 13. Thus, the strap 38 is in the vicinity of and surrounds the anode electrode 13 and is electrically insulated therefrom by the quartz stem 11. This starting device 36 is thus held in place and supported at both ends thereof, and, being positioned behind the lamp 3, has no appreciable effect on the light output of the lamp-reflector combination. The starting device 36 is spaced closer to the electrode 13 than to the arc space in the bulb between the tips of the electrodes 13, 14. The wire 37 can be spaced away from the discharge bulb.

By using the starting device 36 as shown and described above, the voltage for starting the lamp 3, which is known commercially as the General Electric Company MARC 300 projector lamp, was reduced to a value of about 4,000 to 6,000 volts, whereas without the starting device 36, the starting voltage was about 8,000 to 12,000 volts, for typical groups of production lamps, the starting pulse being a fast-rising d-c pulse having its positive polarity applied to the anode and its negative polarity applied to the cathode, and having a rise time of about one microsecond. For a d-c operated short-arc lamp, as shown, better starting characteristics are obtained when the starting device is connected to the cathode electrode 14 and brought near the anode electrode 13, than if arranged vice versa. Instead of providing the strap 38, the end of the wire 37 can be bent around the stems 11.

Figure 5:
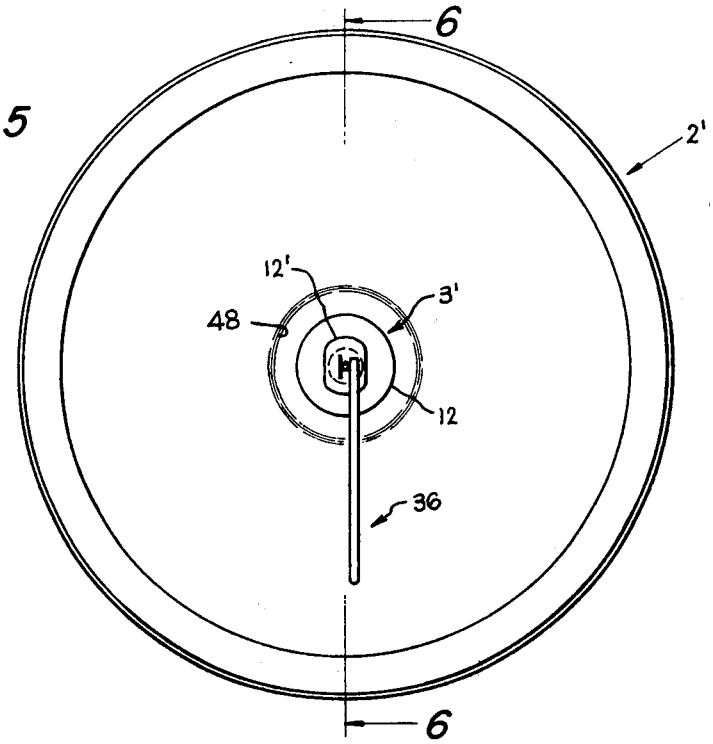
FIG. 5 is a front view of a lamp and reflector combination in accordance with another preferred embodiment of the invention.
Figure 6:
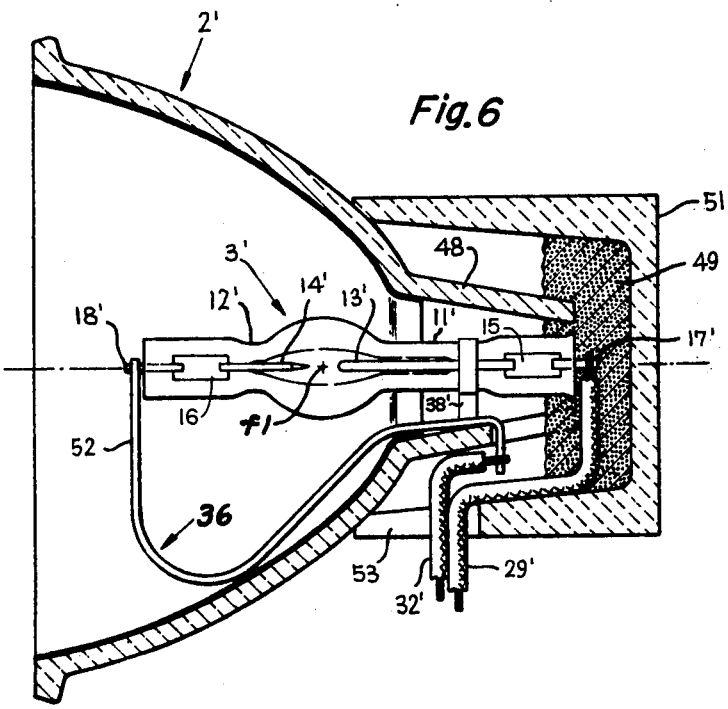
FIG. 6 is a cross-sectional view taken on the line 6—6 of FIG. 5.

In the embodiment of FIGS. 5 and 6, the lamp 3' is the same as or similar to the lamp 3 described above, and is mounted along the optical axis of a concave reflector 2' having a circular configuration in all planes thereof perpendicular to the optical axis. The anode stem 11' of the lamp extends into a hollow collar 48 at the rear of the reflector, where it is cemented to the reflector by cement 49 which also holds a ceramic end cap 51 in place. A connector wire 29' is attached to the inlead 17' of the anode electrode, and a connector wire 32' is attached to an end of a stiff wire 52, curved as shown and with its other end connected to the cathode inlead 18'. The connector wires 29' and 32' are brought out of the end cap 51 through an opening. The embodiment of FIGS. 5 and 6, as thus far described, is similar to the projector lamp disclosed in the above-referenced Slomski patent.

In accordance with the present invention, a metal strap 38' is welded or otherwise connected to the wire 52 at a location within the hollow collar 48 and where the wire is relatively near the anode stem 11' of thelamp 3', and the strap 38' fits around and encircles the anode stem 11'. The connector wire 52, in addition as functioning as an operating current conductor for the cathode 14', also functions, in cooperation with the metal strap 38', as a starting device 36 for the lamp 3' in the same manner as in the embodiment of FIGS. 1–4.

It is not fully understood how the starting device of this invention achieves the reduction in starting voltage of the short-arc lamp. The theory of operation of starting aids used for other types of lamps is better understood. For example, fluorescent lamps have been provided with a metal starting stripe connected to one electrode and extending along the bulb and hence along the discharge path. Also, high pressure metal vapor arc lamps having an elongated discharge path between electrodes in an elongated envelope, have been provided with an external starting aid in the form of a conductor connected to one electrode and encircling the envelope at a point along the discharge path. These types of starting aids in function by creating an electric field in the discharge path, and/or by distorting the electric field produced in the discharge path, so as to initiate a starting discharge in a portion of the discharge path between an electrode and the starting aid. These types of starting aids and their theory of operation are not feasible for short-arc lamps such as described above in which the arc length is less than the bulb outer diameter. However, test results have demonstrated the starting aid of the present invention, which extends beyond the arc discharge path and is capacitively coupled to an electrode via the dielectric of the stem, achieves its objectives.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. An arc discharge lamp comprising an envelope having a bulb portion and an elongated stem extending from said bulb portion, and first and second electrodes extending into said envelope and spaced apart therein in said bulb portion to define an arc discharge path, said first electrode being part of an elongated electrode structure hermetically sealed in said stem at a region thereof spaced from said bulb portion, said first electrode extending through said stem from said seal region and into said bulb portion, wherein the improvement comprises a starting device of electrically conductive material positioned externally of said envelope and connected electrically to said second electrode and extending from said second electrode to and fitting around and substantially encircling said stem alongside said first electrode between said seal region and said bulb portion.

2. A lamp as claimed in claim 1, in which said lamp is intended for d-c operation and said second electrode is a cathode and said first electrode is an anode.

3. A lamp as claimed in claim 1, in which said starting device is connected to additionally function as a current supply conductor for said second electrode.

4. A lamp as claimed in claim 1, in which said envelope includes a bulb portion containing said arc discharge path and a pair of stems extending from opposite ends of said bulb portion and along a common axis, said electrodes respectively extending through said stems along said common axis, in which said starting device encircles a portion of said stem containing said first electrode.

5. A lamp as claimed in claim 1, in which said starting device comprises a wire connected electrically to said second electrode and a metal strap connected electrically to said wire and encircling said stem containing said first electrode.

6. A lamp as claimed in claim 1, in combination with a concave reflector, said lamp being positioned in said reflector along an axis transverse to the optical light projection axis of said reflector, said starting device comprising an elongated member positioned between said lamp and the rear of said reflector.

7. A lamp and reflector combination as claimed in claim 6, in which said lamp is intended for d-c operation and said second electrode is a cathode and said first electrode is an anode.

8. A lamp as claimed in claim 1, in combination with a concave reflector having an optical light projection axis, means positioning said lamp in said reflector along said optical axis with said second electrode relatively toward the front of the reflector and said first electrode relatively toward the rear of the reflector, said starting device being connected to said second electrode and encircling the stem of said first electrode, and means for connecting a current supply to said starting device toward the rear of said reflector whereby said starting device additionally functions as a current supply conductor for said second electrode.

9. A lamp and reflector combination as claimed in claim 8, in which said lamp is intended for d-c operation and said second electrode is a cathode and said first electrode is an anode.

10. A lamp as claimed in claim 1, in which said bulb portion has an outside diameter greater than the length of said arc discharge path, and said stem having an outside diameter smaller than that of said bulb portion.

11. An arc discharge lamp comprising an envelope having a bulb portion and a pair of stems extending from opposite ends of said bulb portion and along a common axis, and a pair of electrodes respectively extending through said stems along said common axis and having ends thereof spaced apart within said bulb portion to define an arc discharge path, each of said electrodes respectively being parts of elongated electrode structures respectively hermetically sealed in said stems at regions thereof spaced from said bulb portion, wherein the improvement comprises a starting device of elongated electrically conductive material positioned externally of said envelope and connected electrically to one of said electrodes and extending to the vicinity of the other electrode and fitting around and sustantially encircling the stem at a location between its seal region and said bulb portion.

* * * * *